United States Patent [19]

Huck

[11] 4,028,746

[45] June 14, 1977

[54] PORTABLE TOILET

[76] Inventor: Gerald N. Huck, 4417 Viking, Houston, Tex. 77018

[22] Filed: July 28, 1975

[21] Appl. No.: 599,358

[52] U.S. Cl. ..... 4/10; 4/DIG. 2; 4/DIG. 13

[51] Int. Cl.[2] ..... E03D 5/02; E03D 5/09

[58] Field of Search ..... 4/1, 10, 12, 32, 69, 4/71, 72, 76, 78, 80, 89, 115, 116, 134, 137, 138, 142, DIG. 2, DIG. 13

[56] References Cited

UNITED STATES PATENTS

| | | | |
|---|---|---|---|
| 2,552,546 | 5/1951 | Furgusson | 4/DIG. 2 |
| 2,879,519 | 3/1959 | Mueller | 4/DIG. 2 |
| 3,251,068 | 5/1966 | Milette et al. | 4/78 |
| 3,772,711 | 11/1973 | Spector | 4/10 |

*Primary Examiner*—Richard E. Aegerter
*Assistant Examiner*—Stuart S. Levy
*Attorney, Agent, or Firm*—Bill B. Berryhill

[57] ABSTRACT

A portable toilet comprising: a housing at least a portion of which defines a reservoir for holding clean flushing fluid; a toilet bowl connected to said housing for upward pivoting movement from a normal horizontal position, in which flushing fluid and body wastes may be retained therein, to a dumping position, in which the flushing fluid and body wastes may be dumped; a container disposed in the housing and connected to the toilet bowl for receiving the flushing fluid and body wastes dumped therefrom; and transfer apparatus associated with the toilet bowl and operable upon its movement to the dumping position and return to the normal position, to transfer flushing fluid from the reservoir to the toilet bowl.

13 Claims, 4 Drawing Figures

PORTABLE TOILET

BACKGROUND OF THE INVENTION

1. Field of the Invention

The present invention pertains to portable toilets. More specifically, it pertains to portable toilets of the flushing type.

2. Description of the Prior Art

With increased traveling, camping and outdoor recreational activities, there has been an associated increase in the need for disposing the trash and waste created by the populace involved in these activities. This is particularly true of body waste. At the same time, the awareness of our environment has required that better apparatus and facilities be devised for disposing of such body waste.

In recent years, several portable toilets have been developed for receiving body waste and for holding and subsequent disposal of such at a suitable collection point. Although several have been developed, there are basically two types of portable toilets: those that flush and those that don't. The no-flush toilets are the simplest, the cheapest, and the most trouble-free. However, they are less appealing, generally have more odor and may be more difficult to empty.

The flush type portable toilet is usually provided with a waste-holding compartment and some type of tank or reservoir for flush liquid. So far as is known by the applicant, flushing of all flush-type toilets requires repeated stroke operation of a hand pump. An example of such a flush-type portable toilet may be seen in U.S. Pat. No. 3,801,991. Such operation leaves much to be desired and, particularly with children, may not be used. Such hand pumps also increase the cost of the toilet and the likelihood of maintenance problems.

In addition to the problems associated with pumping flushing fluid, many portable toilets are inconvenient to empty and clean after use. There are other disadvantages in most of the presently available portable toilets.

SUMMARY OF THE PRESENT INVENTION

In the present invention, a flush-type portable toilet is provided without requiring hand pump operation for flushing. Such operation is made possible by mounting the toilet bowl in a housing for upward pivoting movement from a normal horizontal position, in which flushing fluid and body waste may be retained therein, to a dumping position, in which the flushing fluid and body waste may be dumped into a container which is disposed in the housing.

Also provided is transfer means, operable upon movement of the toilet bowl to the dumping position and return to the normal position, to transfer flushing fluid from the reservoir to the toilet bowl. Alternate designs of the transfer means are disclosed.

Another unique feature of the portable toilet of the present invention is the container for receiving the flushing fluid and body waste dumped from the toilet bowl. The container is preferably flexible and disposed within the reservoir so that its outer surfaces are in contact with the surrounding clean flushing fluid. Thus, as fluid and body waste are collected in the container, fresh flushing fluid is displaced thereby to maintain the level of the flushing fluid above a predetermined level.

The resulting portable toilet is both commercial and highly functional. Flushing is automatic, replenishing of flushing fluid is infrequent, emptying is easy and sanitary. Many other objects and advantages of the invention will be apparent from a reading of the description which follows in conjunction with the accompanying drawings.

DESCRIPTION OF PREFERRED EMBODIMENTS

Figure 1:
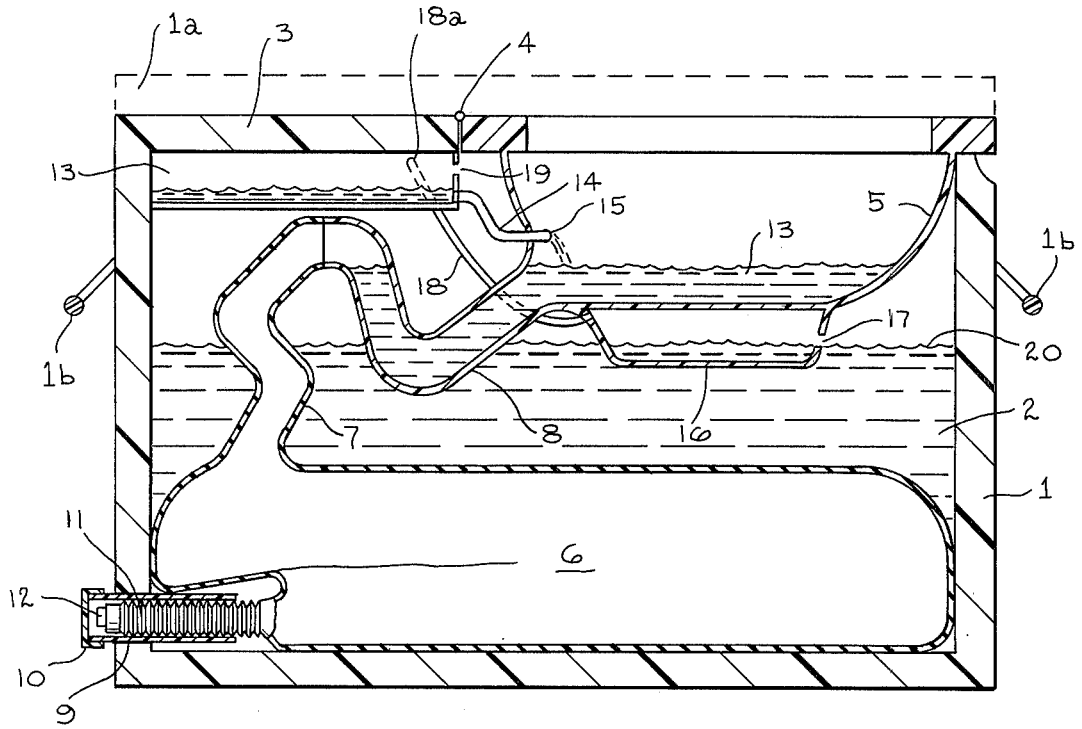
FIG. 1 is an elevation view, partially in section, of a portable toilet according to a preferred embodiment of the invention, illustrating the bowl in its normal horizontal position.
Figure 2:
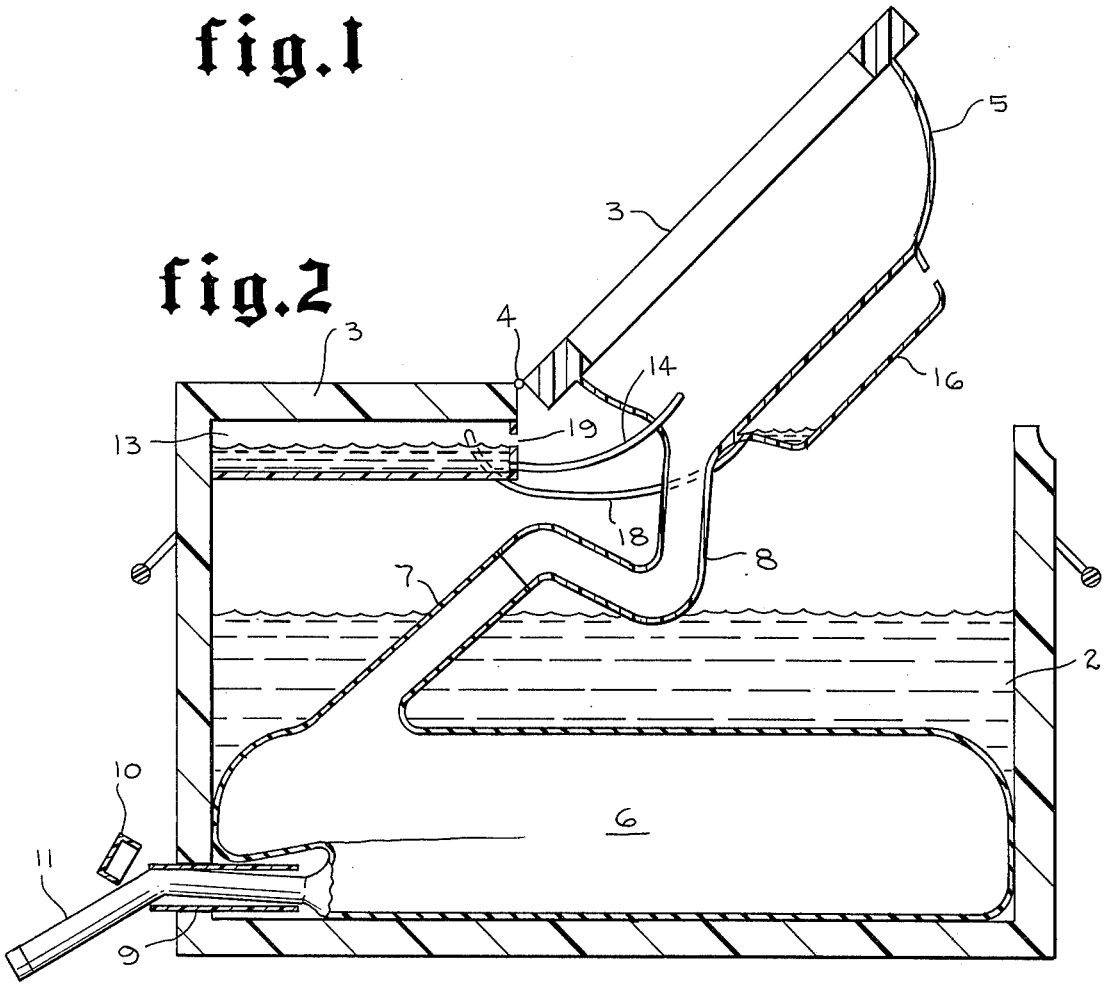
FIG. 2 is a horizontal elevation view, partially in section, similar to FIG. 1, illustrating the bowl in its dumping position.

Referring first to FIGS. 1 and 2, there is shown a portable toilet, according to a preferred embodiment of the invention, having a surrounding housing or chest 1. The chest is preferably of a strong, lightweight material, such as STYROFOAM, but must be watertight, confining a reservoir for holding a supply of clean flushing fluid 2. The flushing fluid is preferably water or water mixed with chemicals for reducing bacterial action and obnoxious odors. The housing 1 may be provided with a cover or lid 1*a* illustrated by dotted lines in FIG. 1. Carrying handles 1*b* and a toilet tissue holder (not shown) may also be provided.

The chest may be provided with a top section 3 which is pivoted at 4 for articulation as shown in FIG. 2. The articulated portion, which has a hole in the center thereof, provides the seat for a toilet bowl 5. Thus, the toilet bowl is mounted for upward pivoting movement from the normal horizontal position of FIG. 1 to a dumping position, as shown in FIG. 2.

Disposed in the fluid reservoir 2 is a container 6 for receiving flushing fluid and body waste dumped from the toilet bowl 5. The container 6 is preferably of a resilient flexible material, such as plastic or rubber, and may be connected to the toilet bowl 5 by an inlet tube 7 and trap 8. An emptying device may be provided for the bag 6 and may comprise a recessed tube 9 and closure member 10 for holding a flexible and extendable dump hose 11 which may be closed by a suitable plug 12. The flexible hose 12 is actually attached to the bag 6 and may be a part thereof.

It is preferable to provide flushing fluid in the bowl 5 at some predetermined level, such as 13 in FIG. 1. For this reason, it is necessary to provide a means of transferring flushing fluid from the reservoir 2 to the toilet bowl 5. To this end, a flush tank 13 may be mounted in the housing at some level above the desired level of fluid 13 in the toilet bowl 5. The flush tank 13 is in fluid communication with the toilet bowl through a conduit 14 and port 15. It will be noted that in the normal position of FIG. 1, any fluid in the flush tank 13 will flow by gravity into the bowl 5.

Attached to the bottom of the toilet bowl 5 is a compartment 16 opened at 17 to receive fresh flushing fluid from the reservoir 2 when the bowl is in the normal position of FIG. 1. The compartment 16 is in fluid communication with the flush tank 13 by means of a conduit 18. The upper end 18*a* of the conduit 18 is at a level near the top of flush tank 13. It will be noted that when the toilet bowl 5 is in the dump position of FIG. 2, flush fluid will flow by gravity into the flush tank 13. An overflow port 19 may be provided in the flush tank so that a premeasured amount of flushing fluid may be received therein.

For initial use, the toilet reservoir is filled to a minimum level 20 with flushing fluid. This will cause the compartment 16 below the toilet bowl 5 to be filled. Then the toilet bowl 5 is pivoted to the dumping position of FIG. 2, causing the fluid from compartment 16 to be transferred by gravity into the flush tank 13. Then the toilet bowl 5 is returned to the normal position of FIG. 1, allowing the flush fluid in flush tank 13 to be transferred by gravity through conduits 14 and 15 into the toilet bowl 5 raising the level therein to the desired level 13. The trap 8 prevents the water from draining into the container 6. At the same time, the compartment 16 is being refilled.

After the toilet is used, it is again raised to the pivoted dumping position of FIG. 2, causing the flushing fluid and body waste in the toilet bowl 5 to be dumped into the container 6. Upon return of the toilet bowl 5 to the normal position of FIG. 1, it is again automatically replenished with fresh flushing fluid. This cycle may be repeated for each use.

Since the container bag 6 is flexible, any fluid and body waste collected therein will displace flushing fluid in the reservoir 2, maintaining the level in the reservoir above the minimum desired level 20, yet will prevent body waste from contaminating the reservoir 2.

After repeated use, the collected fluid and body waste can be dumped by removing the closure 10 and allowing the flexible hose 12 to extend therefrom. (See FIG. 2). After positioning the flexible hose 11 over a suitable sewer collection point, the plug 12 can be removed and the collected body wastes may be dumped into the sewer. The remaining surrounding flushing fluid in the reservoir 2 aids in emptying the container 6 by applying an external pressure thereto and helps assure that the container 6 is completely empty. It may be flushed by holding the toilet bowl 5 in the dumping position of FIG. 2 and circulating clean water therethrough.

Figure 3:
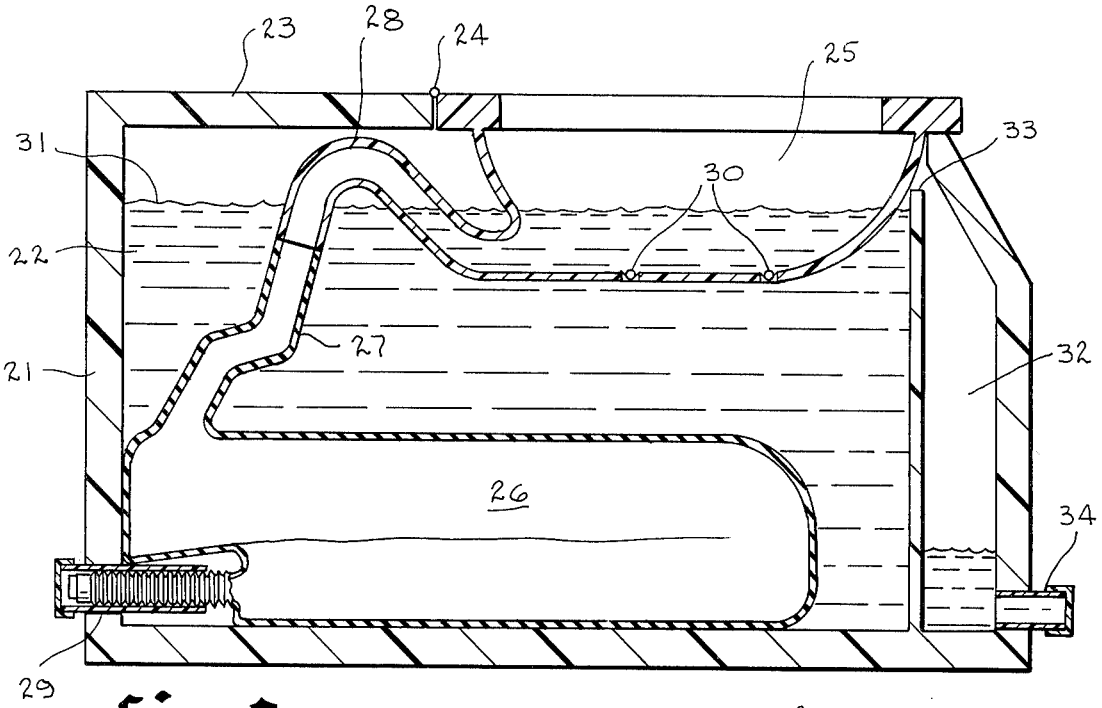
FIG. 3 is a elevation view, partially in section, illustrating an alternate embodiment of the invention.

Referring now to FIG. 3, an alternate embodiment of the invention will be described in which the flush fluid collecting compartment and flush tank may be eliminated. Like in the embodiment of FIGS. 1 and 2, this portable toilet comprises a chest or housing 21 defining a reservoir for holding clean flushing fluid 22. The chest is provided with a top 23 pivoted at 24 for articulation from the normal horizontal position shown in FIG. 3 to a dumping position, similar to the position shown in FIG. 2 for the previously described embodiment. Like in the previous embodiment, the articulated portion of the top 23 is provided with a hole beneath which is the toilet bowl 25.

Disposed in the housing is a flexible bag or container 26 for receiving fluid and body waste dumped from the toilet bowl 25. The container may be attached to the bowl by a flexible tube 27 and trap 28 as in the previous embodiment. An outlet 29 may also be provided.

The means for introducing clean flushing fluid to the toilet bowl 25 is unique in this embodiment and may comprise a plurality of ports 30 located therein to provide fluid communication between the fluid flushing reservoir 22 and the toilet bowl 25. To prevent contaminated water from being introduced into the reservoir 22, the ports 30 may be provided with check valves which allow flow into the toilet bowl but prevent flow in the reversq direction.

This means of supplying flushing fluid to the toilet bowl 25 is by fluid displacement and requires that the level of the reservoir be maintained substantially at the level 31 as shown in FIG. 3. For this reason, it is also necessary to provide an overflow compartment 32 in the housing. The top 33 of the overflow compartment is preferably slightly above the desired level 31 of the flushing reservoir 22.

The dumping operation of the portable toilet of FIG. 3, is essentially the same as the previously described embodiment. The articulated portion of the top 23 and toilet bowl 25 are raised to the dump position (similar to FIG. 2) causing the flush fluid and body waste to be dumped into the container 26. It will be understood that upon raising of the toilet bowl 25, the level 31 of the reservoir 22 would normally drop by a slight amount. However, since the fluid and body waste in the toilet bowl 25 are then dumped into the flexible container 26, the level 31 would rise by that volume.

Then the toilet bowl 25 would be returned to its normal horizontal position. As this is done, the bottom of the toilet bowl 25 would displace a certain amount of flushing fluid which would flow through the ports 30 into the toilet bowl 25, leaving the toilet bowl with a fresh supply of flushing fluid and ready for another use. Any excess of flushing fluid displaced in the reservoir 22 by filling of the container 26 would flow into the overflow compartment 32 which, if necessary, could be provided with a drain 34 for lowering the level therein. Emptying and cleaning of the container 26 would be essentially the same as with the container of the embodiments of FIG. 1 and 2.

Figure 4:
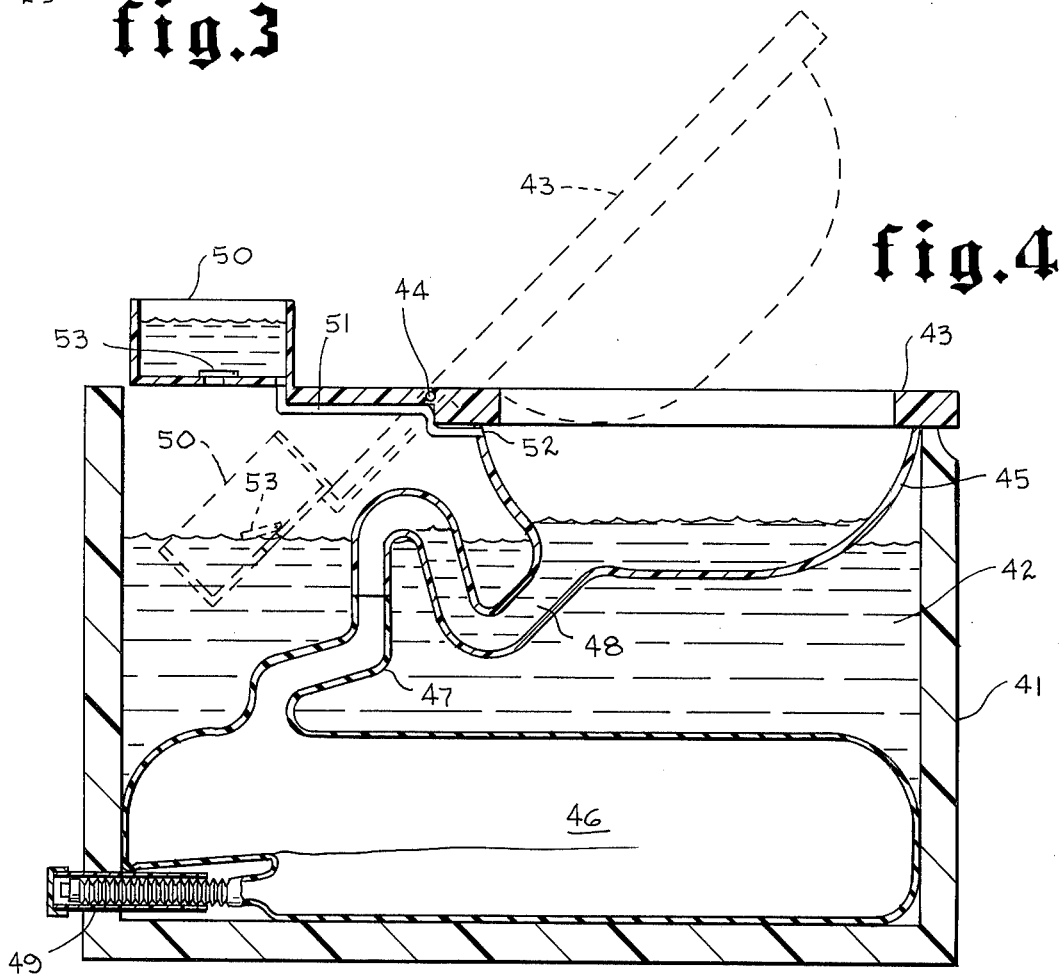
FIG. 4 is an elevation view, partially in section, illustrating still another alternate embodiment of the invention.

Referring now to FIG. 4, still another embodiment of the invention is shown. Like in the previous embodiments, a housing 41 is provided for a reservoir 42 of flushing fluid. A top 43, articulated about a pivot 44, is also provided for raising a toilet bowl 45 from the normal horizontal position of FIG. 4 to a dumping position, as in the previous embodiments.

A flexible bag container 46 is disposed within the reservoir 42 and is connected to the toilet bowl 45 by flexible tubes 47 and trap 48. A drain outlet 49 is also provided.

In this embodiment, still another means for transferring flushing fluid from the reservoir 42 to the toilet bowl 45 is provided. The transfer means comprises a flush tank 50 in fluid communication with the toilet bowl 45 through a conduit 51 and port 52. The bottom of the flush tank is provided with a one-way valve 53. The flush tank 50 is cantilever mounted with the top 43 so that it pivots downwardly as the toilet bowl 45 pivots upwardly when the toilet bowl 45 is dumped as in the previous embodiments. (See dotted line positions shown in FIG. 4) As this is done, the flush tank at least partially enters the reservoir 42 and the one-way valve 53 is opened, permitting fresh flushing fluid to enter the flush tank 50. When the toilet bowl 45 is returned to its normal horizontal position, the valve 53 is closed and the tank 50 returned to its normal position of FIG. 4. Then the flushing fluid in tank 50 is transferred by gravity through the conduit 51 and port 52 into the toilet bowl 45 replenishing it with fresh flushing fluid.

As can be seen the portable toilet of the present invention provides several unique and desirable features not present in the prior art. A portable toilet is provided which flushes automatically and without the need to manually operate a pump. The unique cooperation of the body waste container and fresh flushing fluid reservoir by which it is surrounded, assures a long lasting supply of flushing fluid. Sanitary, odor-reducing holding of body waste, as well as easy disposal is provided. The resulting construction is highly functional, economical and marketable.

Although three embodiments of the invention have been described herein, many others will be apparent to those skilled in the art. For example, the flush tank 13 of the first embodiment described, could actually be provided in an annular chamber surrounding the toilet bowl 5. Many other variations of the invention are possible without departing from the spirit of the invention. Therefore, it is intended that the scope of the invention be limited only by the claims which follow.

I claim:

1. A portable toilet comprising:

housing means, at least a portion of which defines a reservoir for self-contained holding of clean flushing fluid;

a toilet bowl connected to said housing by pivot means from upward pivoting movement from a normal horizontal position, in which flushing fluid and body waste may be retained therein at a predetermined level, to a dumping position, in which said flushing fluid and body waste may be dumped;

a flexible bag container disposed in said reservoir and connected to said toilet bowl for self-contained receiving of said flushing fluid and body waste repeatedly dumped from said toilet bowl upon movement to said dumping position, the outer surfaces of said bag being surrounded and in pressure contact with said clean flushing fluid so that the level of said clean flushing fluid does not fall below its initial level after said repeated dumping of said toilet bowl; and transfer means connected to said toilet bowl and operable, upon its movement to said dumping position and return to said normal position, to transfer flushing fluid from said reservoir to said toilet bowl.

2. A portable toilet as set forth in claim 1 in which said bag is provided with an outlet closed by plug means which may be removed to periodically dump said fluid and body waste contained in said bag.

3. A portable toilet as set forth in claim 1 in which said housing is provided with an overflow compartment in fluid communication with said reservoir and into which flushing fluid displaced by filling of said bag may be received to prevent the level of said flushing fluid from rising above a predetermined level.

4. A portable toilet as set forth in claim 1 in which said transfer means comprises ports in said toilet bowl through which fresh flushing fluid may flow by displacement upon said return of said toilet bowl from said dumping to said normal position.

5. A portable toilet as set forth in claim 4 in which said ports are provided with check valves allowing flow into said toilet bowl but preventing flow through said ports in the reverse direction.

6. A portable toilet as set forth in claim 4 in which said fluid and body waste container comprises a flexible bag disposed within said reservoir so that its outer surfaces are in contact with said clean flushing fluid.

7. A portable toilet as set forth in claim 4 in which said housing is provided with overflow compartment in fluid communication with said reservoir and into which flushing fluid displaced by filling of said bag may be received to maintain a substantially constant level of flushing fluid in said reservoir and said toilet bowl when in said normal position.

8. A portable toilet as set forth in claim 1 in which said transfer means comprises a flush tank in fluid communication with said toilet bowl and positioned at a level, when said toilet bowl is in said normal position, to permit gravity transfer of fresh flushing fluid to said toilet bowl.

9. A portable toilet as set forth in claim 8 in which said flush tank is mounted for movement into said reservoir for receiving fresh flushing fluid therefrom upon said movement of said toilet bowl to said dumping position.

10. A portable toilet as set forth in claim 9 in which said flush tank is provided with a port having a valve through which fresh flushing fluid may flow as said flush tank moves into said reservoir, but preventing flow in the reverse direction.

11. A portable toilet comprising:

a toilet bowl connected to said housing by pivot means for upward pivoting movement from a normal horizontal position, in which flushing fluid and body waste may be retained therein at a predetermined level, to a dumping position, in which said flushing fluid and body waste may be dumped;

a container disposed in said housing and connected to said toilet bowl for receiving said flushing fluid and body waste dumped from said toilet bowl upon movement to said dumping position;

a compartment attached to the bottom of said toilet bowl and opened to receive fresh flushing fluid from said reservoir when said bowl is in said normal position;

a flush tank disposed above said predetermined fluid level of said toilet bowl;

first conduit means connecting said compartment and said flush tank for gravity transfer of fresh flushing fluid from said compartment to said flush tank upon movement of said toilet bowl toward said dumping position; and second conduit means connecting said flush tank and said toilet bowl for gravity transfer of fresh flushing fluid from said flush tank to said toilet bowl on return of said toilet bowl to said normal position.

12. A portable toilet as set forth in claim 11 in which said fluid and body waste container comprises a flexible bag disposed within said reservoir so that the level of said fresh flushing fluid is maintained at at least the initial level therein after a number of dumpings of said toilet bowl into said container.

13. A portable toilet as set forth in claim 11 in which said toilet bowl and said container are connected by trap means, maintaining said predetermined fluid level in said toilet bowl when in said normal position.

* * * * *